US005731667A

United States Patent [19]

Luchetta et al.

[11] Patent Number: 5,731,667

[45] Date of Patent: Mar. 24, 1998

[54] HYBRID SEQUENCE START BALLAST FOR AN INSTANT START DISCHARGE LAMP

[75] Inventors: Julius Frank Luchetta, Pearl, Miss.; Ramkumar Rajan, Fort Wayne, Ind.; Chad Martin, Laurel, Miss.

[73] Assignee: Magnetek, Inc., Nashville, Tenn.

[21] Appl. No.: 395,499

[22] Filed: Feb. 24, 1995

[51] Int. Cl.[6] ..... H05B 41/14

[52] U.S. Cl. ..... 315/323; 315/289; 315/DIG. 5; 315/119; 315/227 R

[58] Field of Search ..... 315/323, 325, 315/294, 289, 227 R, 219, DIG. 5, 102, 106, 107, 116, 119

[56] References Cited

U.S. PATENT DOCUMENTS

| | | | |
|---|---|---|---|
| 4,006,384 | 2/1977 | Elms et al. | 315/323 |
| 4,145,638 | 3/1979 | Kaneda | 315/323 |
| 4,211,958 | 7/1980 | Bickford et al. | 315/312 |
| 4,425,530 | 1/1984 | Hammer et al. | 315/104 |
| 4,547,705 | 10/1985 | Hirayama et al. | 315/219 |
| 4,562,381 | 12/1985 | Hammer et al. | 315/99 |

FOREIGN PATENT DOCUMENTS

| | | | |
|---|---|---|---|
| 0055277 | 5/1977 | Japan | 315/289 |
| 0056776 | 5/1977 | Japan | 315/289 |
| 1396094 | 5/1975 | United Kingdom | 315/323 |

*Primary Examiner*—Robert Pascal
*Assistant Examiner*—Arnold Kinkead
*Attorney, Agent, or Firm*—Darby & Darby

[57] ABSTRACT

In accordance with the present invention, a hybrid sequence start circuit is provided for operating a plurality of instant start lamps. The circuit utilizes two coils, a primary and a secondary, and an electronic switch to start a plurality of series-connected, instant start lamps in sequence. When the circuit is energized, the electronic switch causes open circuit voltage to be applied to a first lamp by placing a low impedance across the other lamps, causing the first lamp to strike. The first lamp then conducts current, causing a starting capacitor in parallel with a second lamp to be charged, eventually, causing the second lamp to strike. The current through the second lamp shunts current away from the switch, and when this current drops below a predefined threshold level, the switch opens, effectively removing both the low impedance and the starting capacitor from the circuit.

4 Claims, 2 Drawing Sheets

HYBRID SEQUENCE START BALLAST FOR AN INSTANT START DISCHARGE LAMP

BACKGROUND OF THE INVENTION

The present invention relates to a ballast for a discharge lamp system, and more particularly concerns a hybrid sequence start ballast for instant start discharge lamps, such as fluorescent lamps.

The significantly greater efficiency of fluorescent or discharge lamps, in terms of lumens per watt, as compared to incandescent lamps has contributed greatly to the wide spread use of fluorescent lamps, especially in commercial fixtures. Multi-lamp fixtures using sequence-start ballasts for instant start fluorescent lamps are particularly common. For purposes of comparison, a circuit diagram of one common circuit is shown in FIG. 1 of the present application.

This sequence start design includes three coils, a primary, secondary and a starting coil. Both the primary and the secondary use medium size wire, however, the starting coil utilizes a fine wire that presents some difficulties in winding. A characteristic feature of this circuit is that lamp rectification occurs towards the end of lamp life, and this generates extreme heat in the ballast and causes failure of the starting coil. The ballast must employ a special heat sensing device to detect this abnormal heat rise. U.S. Pat. No. 4,963,797 discloses one means of sensing heat rise.

It is an object of this invention to provide an instant start fluorescents ballast with increased reliability.

It is another object of this invention to eliminate the need for a fine wire starting coil in a sequence start ballast.

It is another object of this invention to increase lamp life in sequence start ballasts.

It is another object of this invention to eliminate the need for a special heat sensing device in a sequence start ballast.

It is yet another object of this invention to reduce manufacturing costs of sequence start ballasts.

In accordance with the present invention, a hybrid sequence start circuit is provided for operating a plurality of instant start lamps. The circuit utilizes two coils, a primary and a secondary, and an electronic switch to start a plurality of series-connected, instant start lamps in sequence. When the circuit is energized, the electronic switch causes open circuit voltage to be applied to a first lamp by placing a low impedance across the other lamps, causing the first lamp to strike. The first lamp then conducts current, causing a starting capacitor in parallel with a second lamp to be charged, causing the second lamp to strike. The current through the second lamp shunts current away from the switch, and when this current drops below a predefined threshold level, the switch opens, effectively removing both the low impedance and the starting capacitor from the circuit.

BRIEF DESCRIPTION OF THE DRAWINGS

The foregoing and other objects, features and advantages of the present invention will be understood more readily from the following detailed description of preferred embodiments taken in conjunction with the attached drawings wherein.

DETAILED DESCRIPTION OF THE PREFERRED EMBODIMENT

Figure 1:
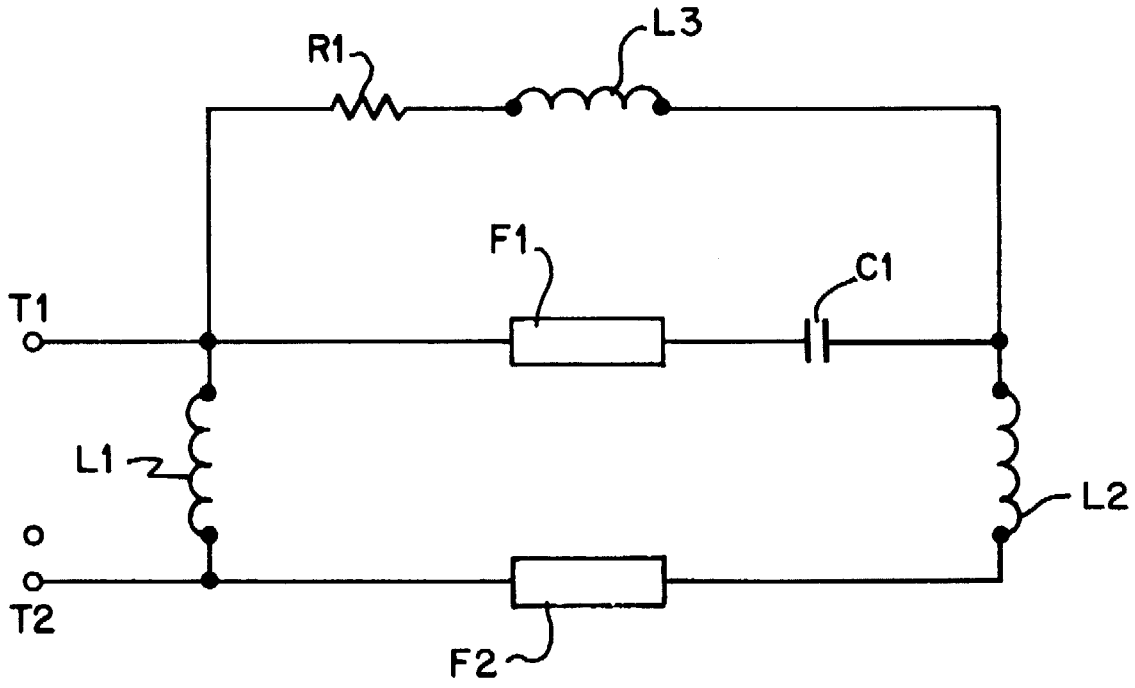
FIG. 1 PRIOR ART
FIG. 1 is a circuit diagram illustrating a prior art sequence start ballast system.

As shown in FIG. 1, in a conventional sequential start ballast, two terminals T1 and T2 are provided for connection to an AC power source (not shown). Primary coil L1 is connected across the power source at terminals T1 and T2. Primary coil L1 has connected across it the series circuit including lamp F1, capacitor C1, secondary coil L2 and lamp F2. Finally, series connected resistor R1 and starting coil L3 are connected across the series combination of lamp F1 and capacitor C1.

In operation, starting coil L3, having a large number of turns, generates a high enough voltage to strike lamp F1, but the high impedance of L3 limits the current in lamp F1 to approximately one half normal operating current. After lamp F1 strikes, the combined voltages of primary coil L1 and secondary coil L2 and the voltage drop across coil L3 are presented across lamp F2. Lamp F2 then strikes, providing a path for the current to both lamps.

The lamp current to both lamps F1 and F2 is controlled only by the impedance of secondary coil L2 and capacitor C1. Under normal operating conditions, the current through the starting coil L3 is very small. The electrodes of the lamps F1 and F2 deteriorate unevenly toward the end of lamp life. When one of the electrodes loses its ability to produce electrons, the lamp current becomes a rectified DC current. This DC current causes abnormal heating that can eventually destroy the ballast. Resistor R1 is therefore necessarily provided as part of a mechanism for detecting the rectified DC current. When the lamp current becomes a rectified DC current, the voltage across resistor R1 increases, thereby heating up the resistor R1. Also required is a automatic resetting thermal protector (not shown) for detecting the temperature of resistor R1. When the temperature of the resistor reaches a predefined threshold, the thermal protector will disconnect the power supply from the circuit, thereby preventing premature failure of the ballast.

Figure 2:
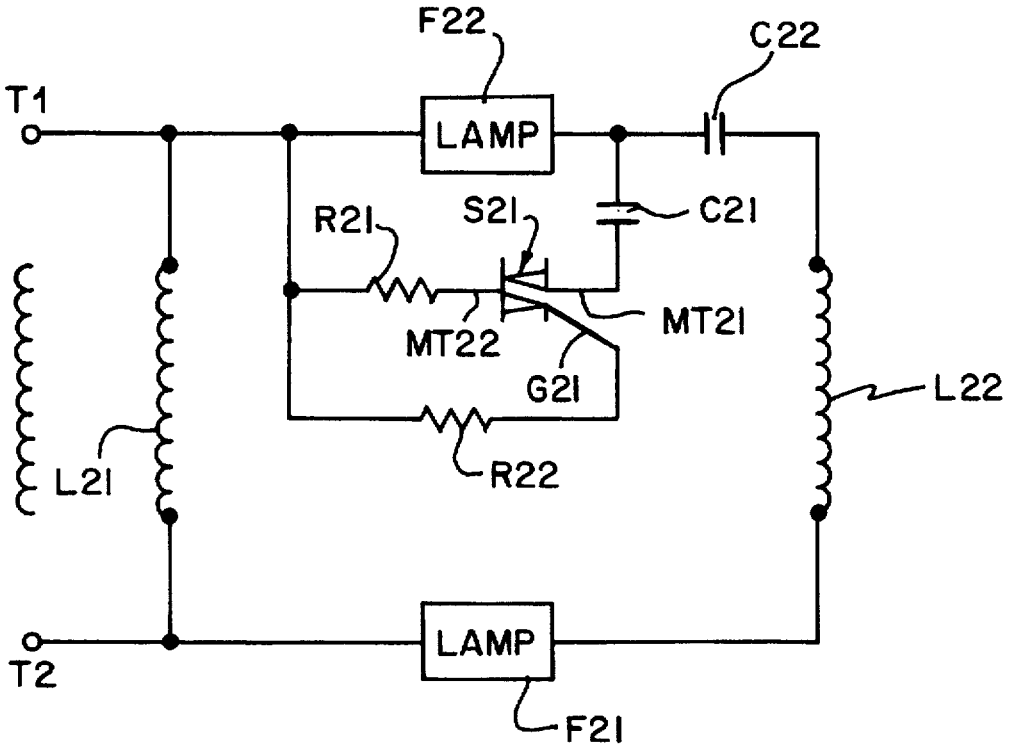
FIG. 2 is a circuit diagram illustrating the novel circuit design for the hybrid sequence start ballast of the present invention.

FIG. 2 illustrates a hybrid sequence start circuit embodying the present invention. Two terminals T1 and T2 are provided for connection to an AC power supply (not shown). Primary coil L21 is connected across the power supply between the terminals T1 and T2. Connected across primary coil L21 is the series circuit comprising instant start lamp F22, capacitor C22, secondary coil L22 and instant start lamp F21. Shunting lamp F22 is the starting circuit comprising resistor R21, electronic switch S21, and starting capacitor C21, preferably 0.15 mF. Electronic switch S21 is preferably a triac switch, and resistor R21 is preferably 100 ohms. Finally, a large value biasing resistor R22 is connected between the gate G21 of the switch S21 and terminal T1. The value of R22 is calculated to bias switch S21 on, when the power supply voltage appears between terminals T1 and T2, and it is preferably 39 Kohms. The present invention has also eliminated the fine wire starting coil of FIG. 1., thereby decreasing manufacturing costs.

Figure 3:
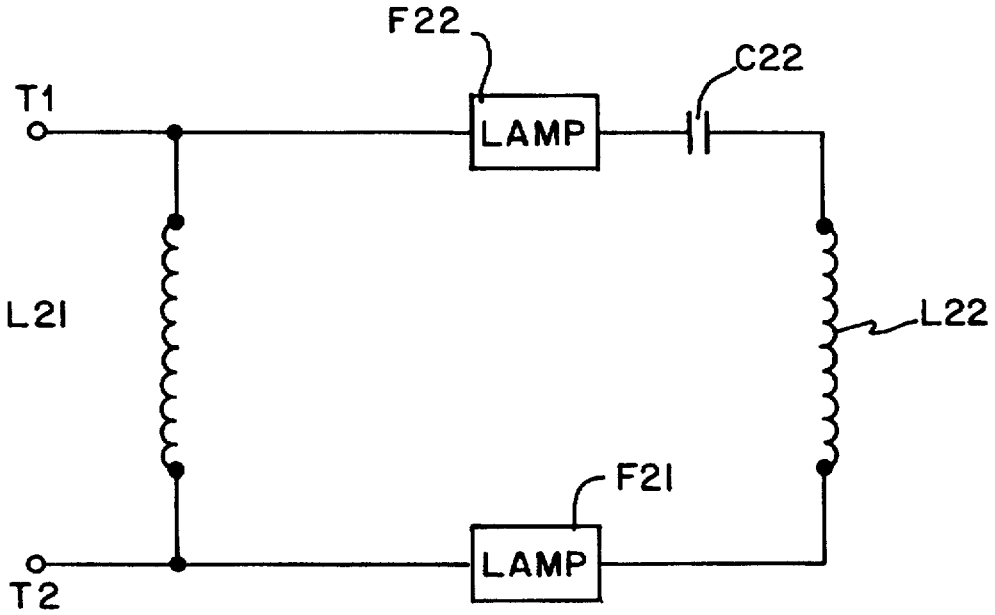
FIG. 3 illustrates the equivalent circuit of a hybrid sequence start ballast in accordance with the invention during normal operation, after the lamps are started.

In operation, an AC power source is connected between terminals T1 and T2. Since switch S21 is biased on, the low impedance of capacitor C21 shunts lamp F22 and open circuit voltage is applied instantaneously to lamp F21, causing it to strike. As a result, a low impedance path is provided through lamp F21. The current flowing in lamp F21 also flows through resistor R21, switch S21 and capacitor C21, causing the capacitor to charge the voltage across this capacitor also appears across lamp F22, and causes lamp F22 to strike. Lamp F22 then provides a low impedance path, shunting current away from switch S21 and causing current flow in the switch to drop below the threshold required to keep it conducting. When switch S21 turns off, starting capacitor C21, and resistors R21 and R22 are effectively removed from the circuit. FIG. 3 illustrates the equivalent circuit, after both lamps F21 and F22 are on.

When the electrodes of the lamps F21 or F22 deteriorate, capacitor C22 protects the circuit from lamp current rectification, thus eliminating the need for a heat sensing device. Further, with the heat problem eliminated, the circuit will be more reliable.

While the invention has been particularly shown and described with reference to a preferred embodiment thereof, it will be understood by those skilled in the art that various additions, modifications and substitutions may be made therein without departing from the spirit and scope of the invention as defined by the accompanying claims.

What is claimed is:

1. In a ballast circuit for a plurality of instant start series connected fluorescent lamps, said ballast circuit being of the type including a primary coil and secondary coil means for connecting an AC power source across the primary coil, a starting circuit comprising:

switching means including an electronic switch responsive to the presence of power from said power source for providing a low impedance path across a first of said lamps, permitting a second of said lamps to strike through the action of said primary and secondary coils, said electronic switch including a triac;

a capacitor coupled in said low impedance path responsive to current drawn by said second lamp after striking for producing a voltage across said first lamp to strike said first lamp; and said switching means also being responsive to the striking of said first lamp to effectively open circuit said low impedance path.

2. The ballast circuit according to claim 1 further comprising a capacitor in series circuit with said lamps to protect against lamp current rectification.

3. A ballast circuit for a plurality of instant start fluorescent lamps in series circuit, comprising:

a primary coil having first and second terminals;

a secondary coil electrically connected in series with the lamps between said first and second terminals;

switching means including an electronic switch responsive to the presence of power from said power source for providing a low impedance path across a first of said lamps, permitting a second of said lamps to strike through the action of said primary and secondary coils, said electronic switch including a triac;

a capacitor coupled in said low impedance path responsive to current drawn by said second lamp after striking for producing a voltage across said first lamp to strike said first lamp; and said switching means also being responsive to the striking of said first lamp to effectively open circuit said low impedance path.

4. The ballast circuit according to claim 3 further comprising a capacitor in series circuit with said lamps to protect against lamp current rectification.

* * * * *